US006024582A

United States Patent [19]

Wu

[11] Patent Number: 6,024,582

[45] Date of Patent: Feb. 15, 2000

[54] CONNECTION SYSTEM

[75] Inventor: Jerry Wu, Chang-Hua, Taiwan

[73] Assignee: Hon Hai Precision Ind. Co., Ltd., Taipei Hsien, Taiwan

[21] Appl. No.: 09/374,075

[22] Filed: Aug. 12, 1999

[51] Int. Cl.[7] ..... H01R 9/09

[52] U.S. Cl. ..... 439/74

[58] Field of Search ..... 439/74, 660

[56] References Cited

U.S. PATENT DOCUMENTS

| | | | |
|---|---|---|---|
| 5,842,875 | 12/1998 | Yagi | 439/74 |
| 5,876,217 | 3/1999 | Ito et al. | 439/74 |
| 5,885,092 | 3/1999 | Ito et al. | 439/74 |
| 5,928,003 | 7/1999 | Kajinuma | 439/74 |
| 5,931,689 | 8/1999 | Patel | 439/74 |

*Primary Examiner*—Gary F. Paumen
*Attorney, Agent, or Firm*—Wei Te Chung

[57] ABSTRACT

A connection system includes a plug connector mounted to a personal digital assistant (PDA) and a mating receptacle connector mounted to a docking station for establishing electrical connection between the PDA and the docking connector. The plug connector includes a first housing defining U-shaped slots for receiving and retaining U-shaped first contacts. Each first contact has a central section exposed to a front mating face of the first housing and first and second limbs each forming transversely extending projections for interferentially engaging with the slot thereby fixing the first contact in position. The receptacle connector includes a second housing defining L-shaped slots for receiving and retaining L-shaped second contacts. Each second contact has an arcuate engaging portion resiliently supported and biased to partially project beyond a front mating face of the second housing through an opening defined in the second housing. The second housing defines a receiving space in front of the mating face thereof for accommodating the plug connector whereby the central section of each first contact engages with and drives the arcuate engaging portion of the corresponding second contact back into the L-shaped slot to form a firm engagement therebetween.

19 Claims, 8 Drawing Sheets

CONNECTION SYSTEM

BACKGROUND OF THE INVENTION

1. Field of the Invention

The present invention generally relates to a connection system for interconnecting a personal digital assistant (PDA) and a docking station, and in particular to a connection system capable of enduring frequent and repeated connections/disconnections.

2. The Prior Art

A personal digital assistant (PDA) is a handy means for a user to process and handle data and information. The PDA, however, has a limited capability and must be connected to an external computer system or network for expansion of resources thereof. A docking station provides interconnection between a PDA and a computer system or network. Mating connectors are provided in the PDA and the docking station of the computer system for facilitating interconnection therebetween.

Docking stations are available in the market for connecting a notebook computer to a network system or for converting a notebook computer to a desktop computer. Such conventional docking stations comprise docking connectors requiring a large amount of space for mating purposes thereby hindering miniaturization of the docking system. Furthermore, some conventional designs for connecting two systems employ a header and socket pair which is incapable of enduring frequent and repeated connections/disconnections.

It is thus desired to provide a connection system for overcoming the problems discussed above.

SUMMARY OF THE INVENTION

Accordingly, an object of the present invention is to provide a durable connection system for connecting a PDA to an external system.

Another object of the present invention is to provide a connection system for reducing the space required to mate connectors thereof.

To achieve the above objects, a connection system in accordance with the present invention comprises a plug connector mounted to a personal digital assistant (PDA) and a mating receptacle connector mounted to a docking station for establishing electrical connection between the PDA and the docking connector. The plug connector comprises a first housing defining U-shaped slots for receiving and retaining U-shaped first contacts. Each first contact has a central section exposed to a front mating face of the first housing and first and second limbs each forming transversely extending projections for interferentially engaging with the slot thereby fixing the first contact in position. The receptacle connector comprises a second housing defining L-shaped slots for receiving and retaining L-shaped second contacts. Each second contact has an arcuate engaging portion resiliently supported and biased to partially project beyond a front mating face of the second housing through an opening defined in the second housing. The second housing defines a receiving space in front of the mating face thereof for accommodating the plug connector whereby the central section of each first contact engages with and drives the arcuate engaging portion of the corresponding second contact back into the L-shaped slot to form a firm engagement therebetween.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
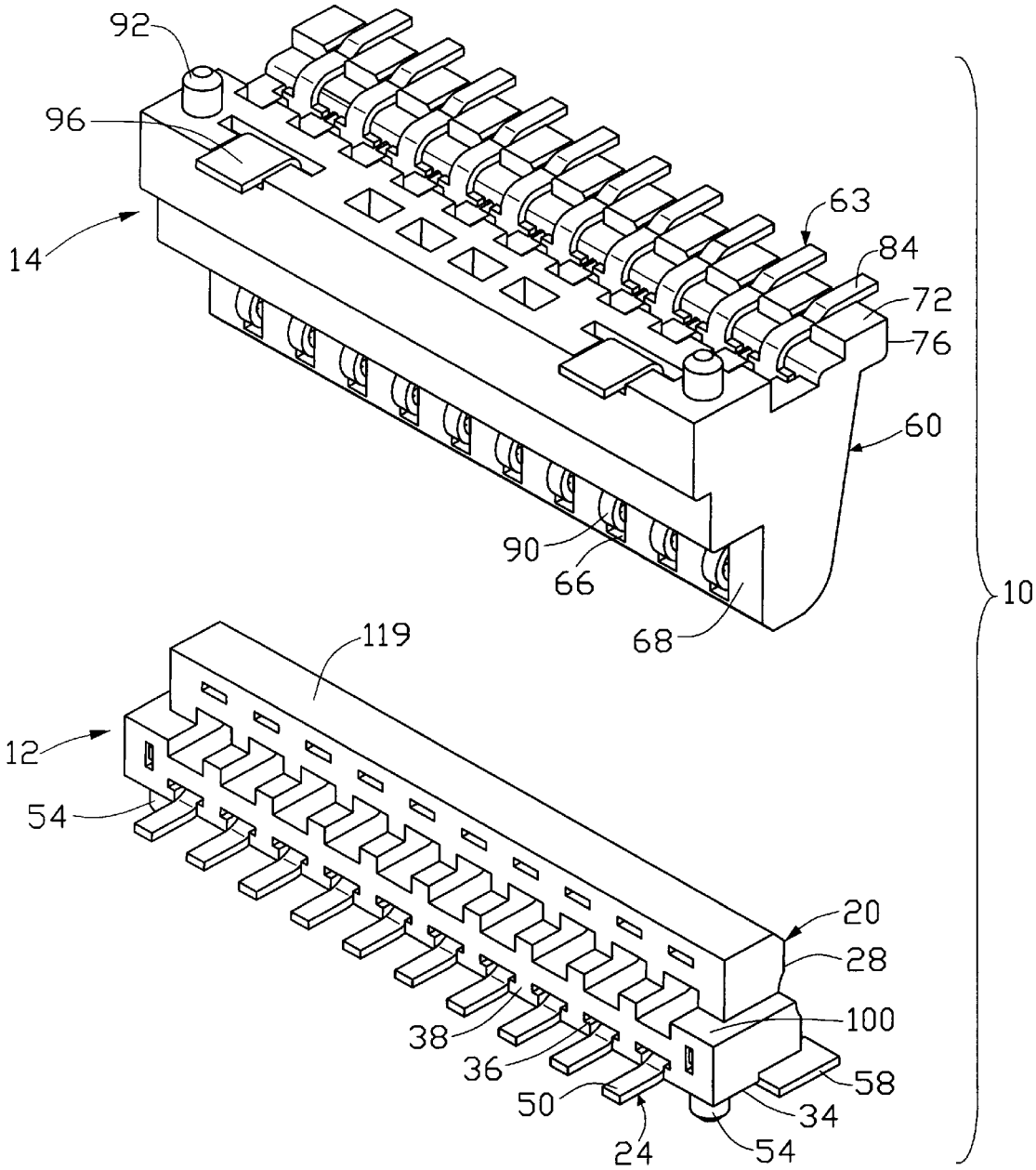
FIG. 1 is a perspective view of a connection system constructed in accordance with the present invention comprising a plug connector and a receptacle connector detached from each other.
Figure 2:
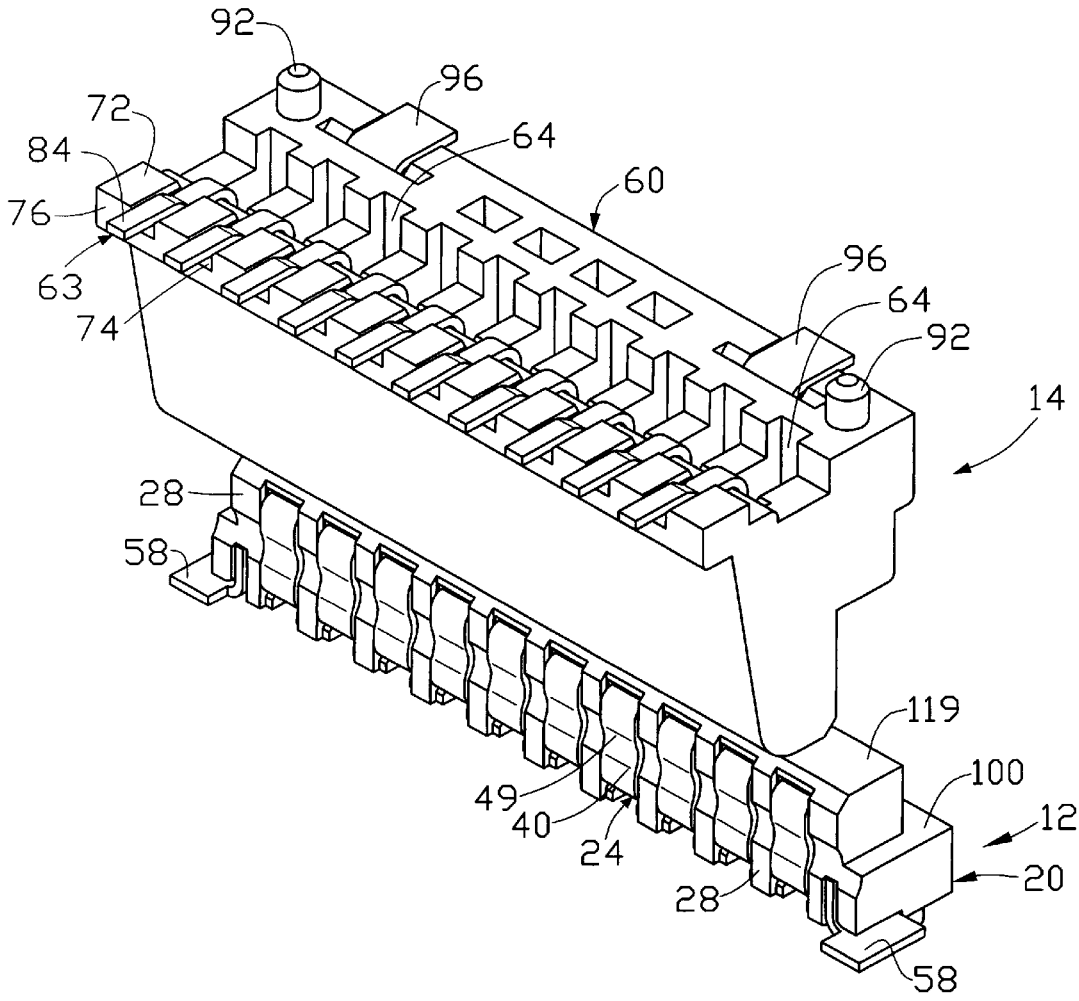
FIG. 2 is similar to FIG. 1, but taken from a different perspective.
Figure 3:
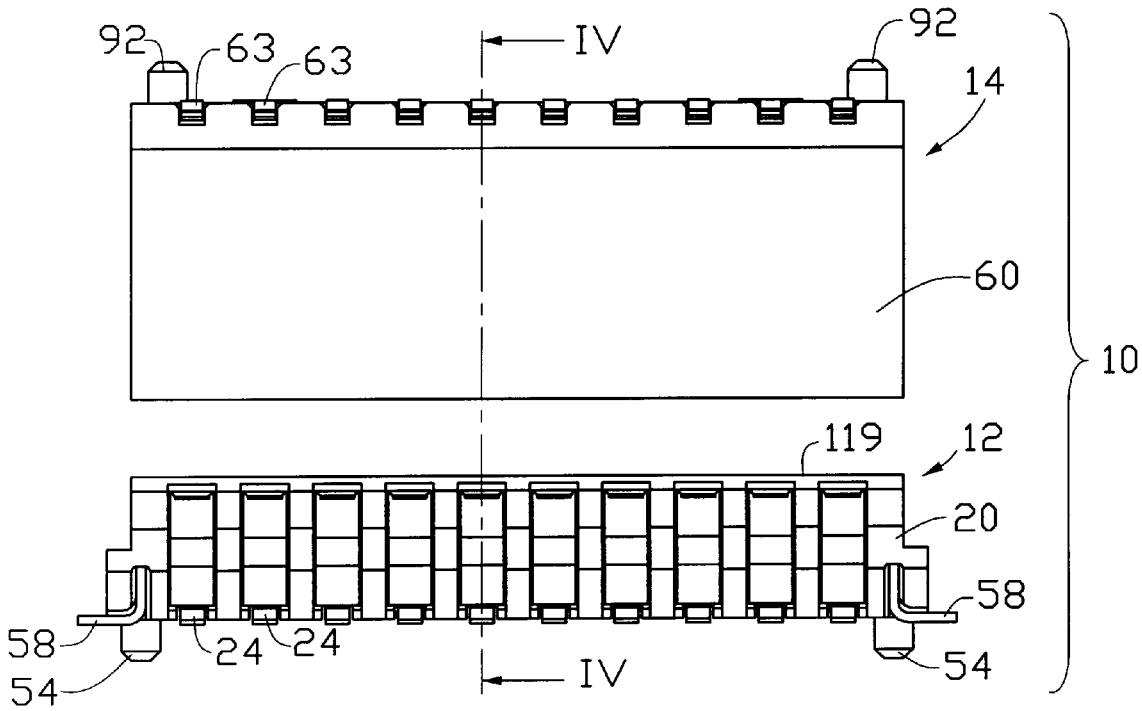
FIG. 3 is a front view of FIG. 1.

Referring to the drawings and in particular to FIGS. 1–3, a connection system 10 constructed in accordance with the present invention comprises a plug connector 12 and a receptacle connector 14 adapted to be mounted to a personal digital assistant (PDA) 16 and a docking station 18 (FIGS. 7 and 8), respectively, for mating with each other and thus forming electrical connection between the PDA 16 and the docking station 18.

Figure 4:
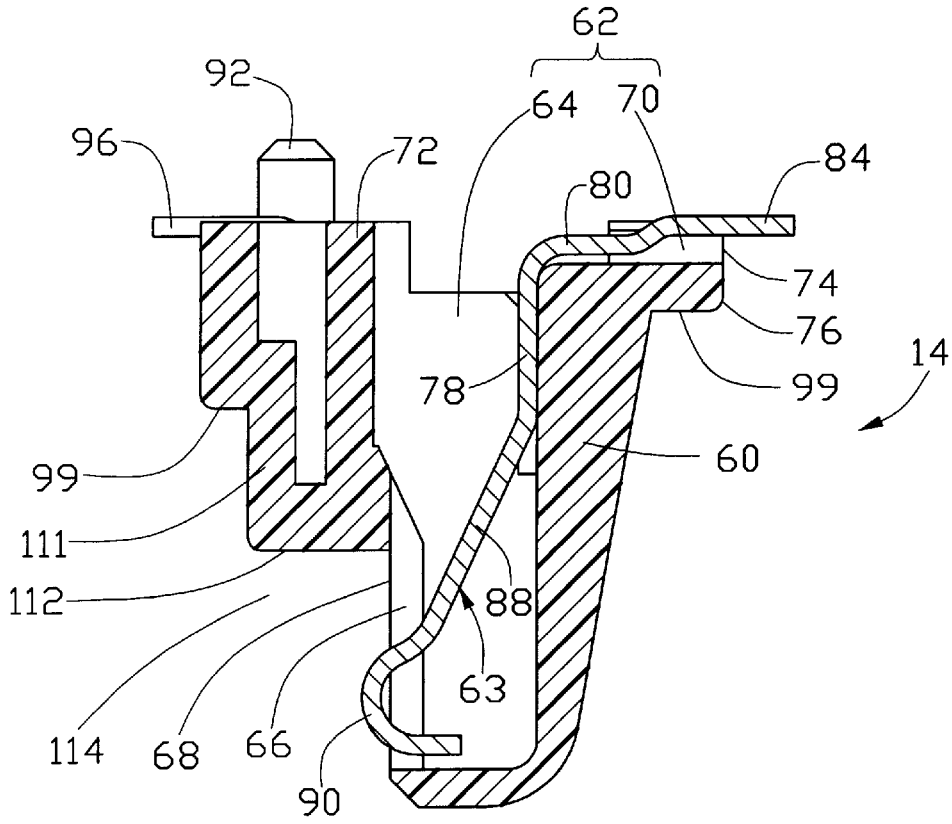
FIG. 4 is a cross-sectional view taken along line IV—IV of FIG. 3.
Figure 4:
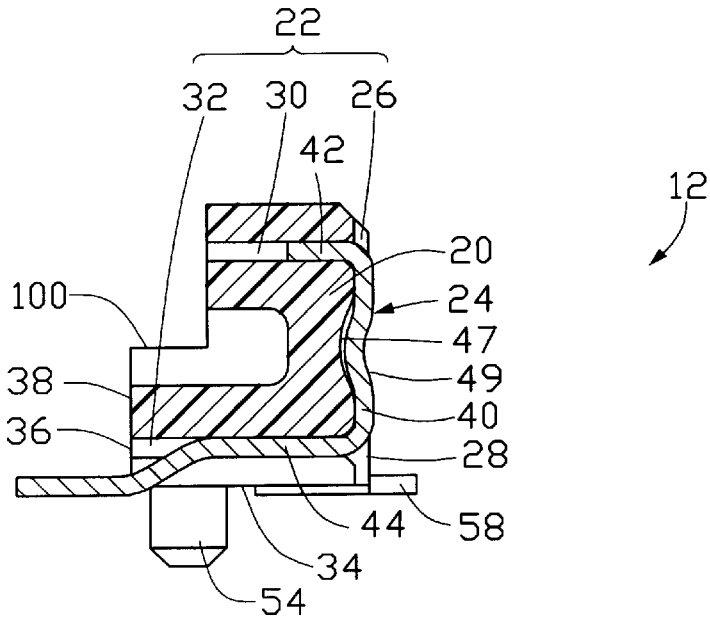

Also referring to FIG. 4, the plug connector 12 comprises a first insulative housing 20 defining a plurality of U-shaped first slots 22 for receiving first contacts 24 therein. Each first slot 22 has a central channel 26 defined in and exposed to a front mating face 28 of the first housing 20 and first and second passages 30, 32 extending from the central channel 26 substantially parallel to each other. In the embodiment illustrated, the second passage 32 is exposed to a bottom face 34 of the first housing 20 for facilitating surface mounting of the first contact 24. However, if a surface mounting technique is not employed, the second passage 32 does not require exposure to the bottom face 34. The second passage 32 forms an opening 36 on a rear face 38 of the first housing 20.

Figure 6:
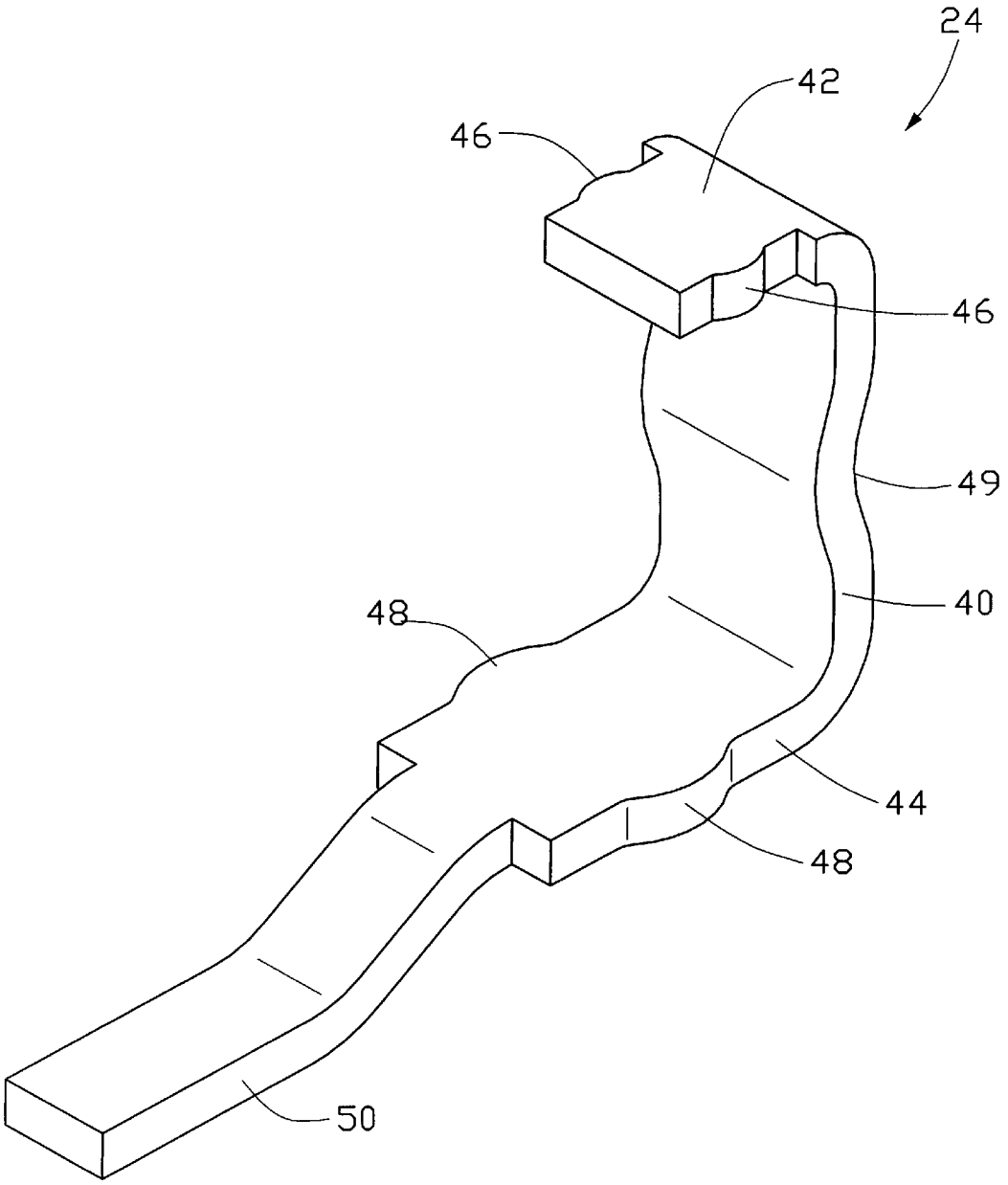
FIG. 6 is a perspective view of a contact of the plug connector.

Also referring to FIG. 6, each first contact 24 is U-shaped and comprises a central section 40 and first and second limbs 42, 44 extending from the central section 40. The central section 40 is received in the central channel 26 of the corresponding slot 22 with the limbs 42, 44 extending into the passages 30, 32. The limbs 42, 44 form projections 46, 48 on opposite edges thereof for mechanically interfering with opposite inside surfaces (not labeled) of the corresponding passages 30, 32 thereby securely retaining the first contact 24 in the slot 22.

A concave portion 49 is formed on the central section 40 of each first contact 24 and a corresponding recess 47 is defined in a bottom side of the central channel 26 for accommodating the concave portion 49. This will be further discussed.

Figure 7:
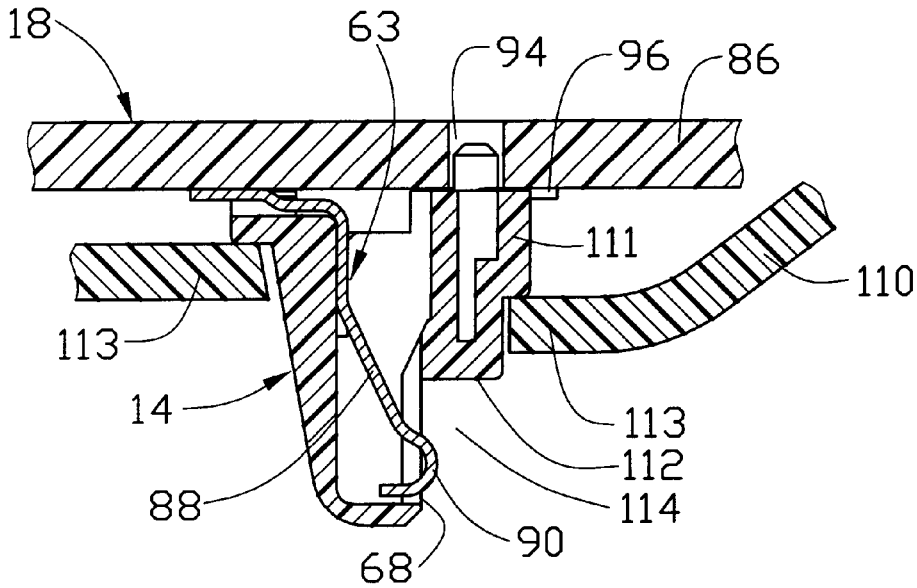
FIG. 7 is a cross-sectional view showing the receptacle and plug connectors respectively mounted to a docking station and a PDA before the connectors mate with each other.
Figure 7:
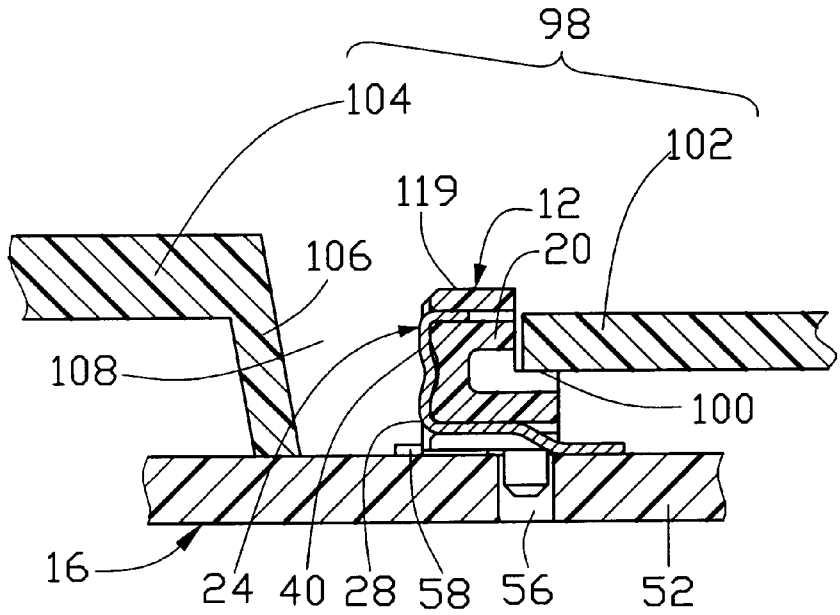
Figure 8:
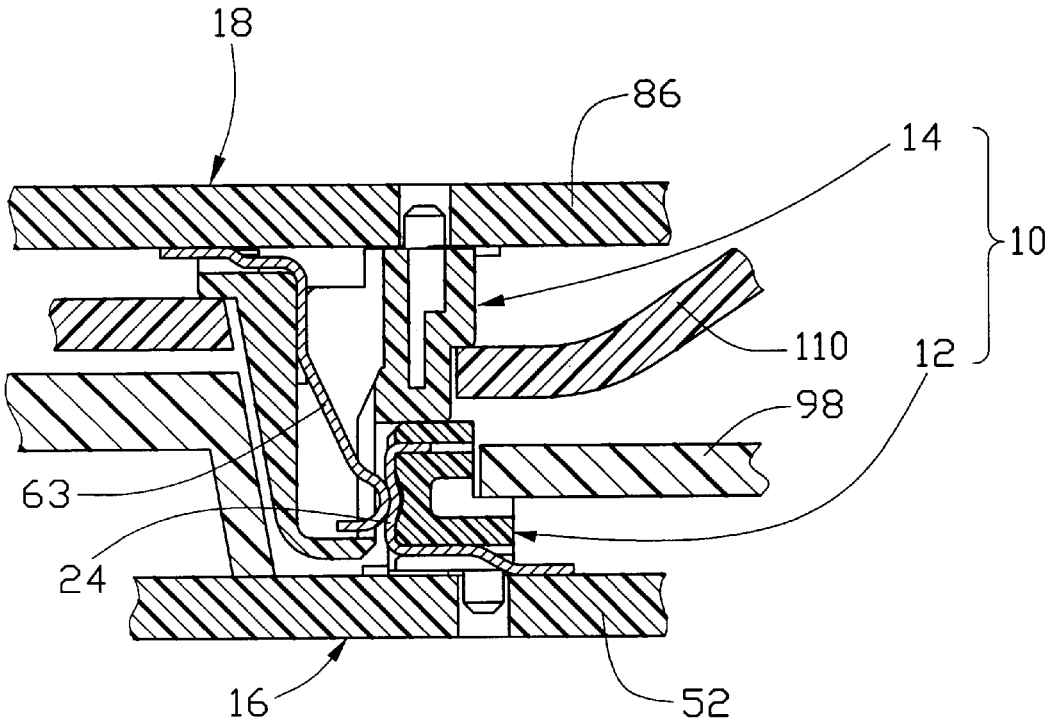
FIG. 8 is similar to FIG. 7, but showing the connectors mating with each other.

A soldering section 50 extends from the second limb 44 of each first contact 24 and projects beyond the rear face 38 of the first housing 20 through the opening 36 of the second passage 32. As shown in FIGS. 7 and 8, the soldering section 50 is surface mounted to a circuit board 52 of the PDA 16. However, the soldering section 50 may be properly deformed and mounted to the circuit board 52 by a through hole technique.

Positioning posts 54 are formed on the bottom face 34 of the first housing 20 for insertion into holes 56 defined in the circuit board 52 to properly position the plug connector 12 with respect to the circuit board 52 of the PDA 16. Solder pads 58 are provided on the bottom face 34 of the first housing 20 for being soldered to the circuit board 52 to more firmly fix the plug connector 12 to the circuit board 52 of the PDA 16.

Referring back to FIGS. 1–4, the receptacle connector 14 comprises a second insulative housing 60 defining a plurality of L-shaped second slots 62 for receiving second contacts 63 therein. Each second slot 62 comprises a primary channel 64 forming an opening 66 on a front mating face 68 of the second housing 60 and a secondary passage 70 extending from the primary channel 64. The secondary passage 70 may be exposed to a bottom face 72 of the second housing 60 for facilitating surface mounting of the second contact 63. The secondary passage 70 forms an opening 74 on a rear face 76 of the second housing 60.

Figure 5:
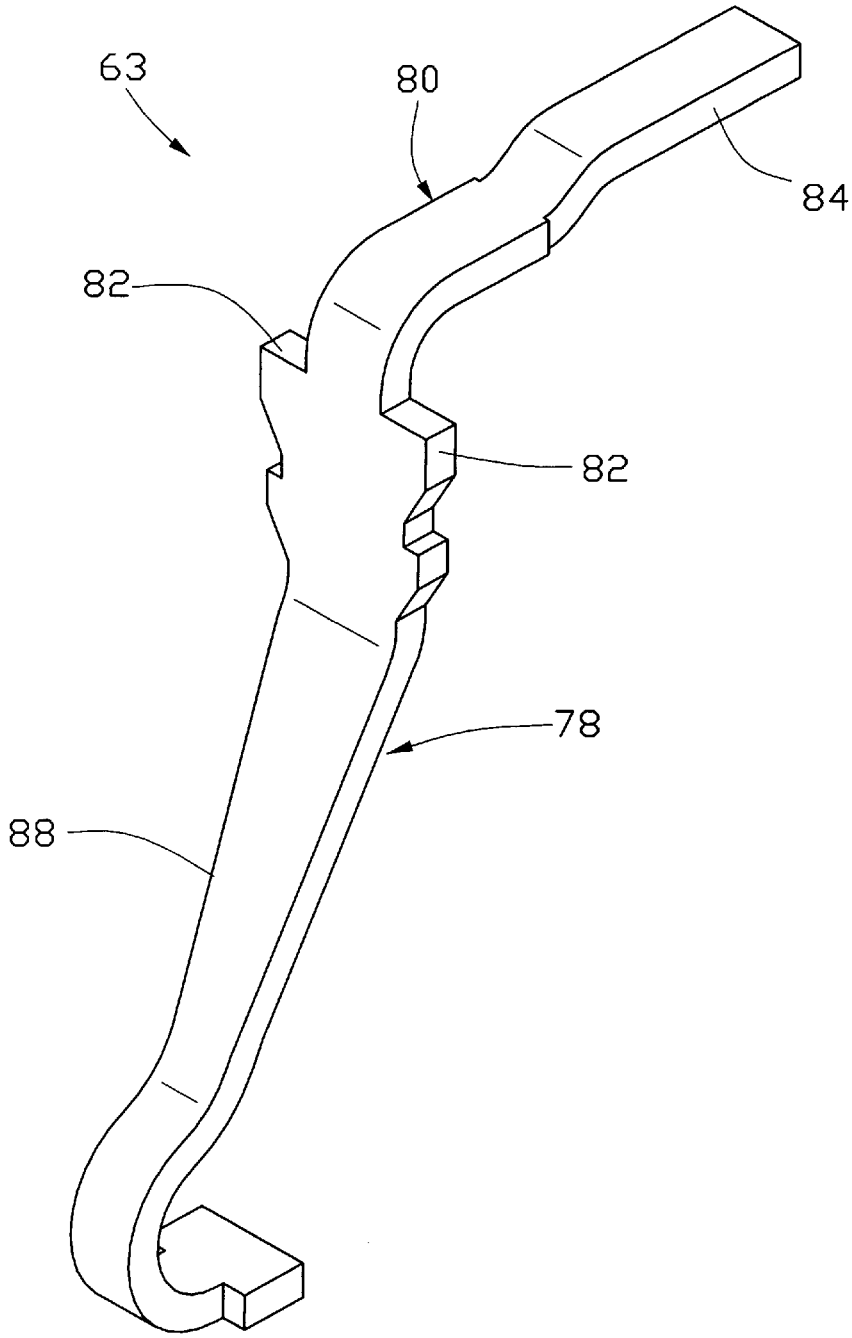
FIG. 5 is a perspective view of a contact of the receptacle connector.

Also referring to FIG. 5, each second contact 63 is substantially L-shaped and comprises a primary section 78 and a secondary section 80 extending from the primary section 78. The primary section 78 is inserted into the primary channel 64 of the corresponding slot 62 with the secondary section 80 received in the secondary passage 70. Projections 82 are formed on opposite edges of the primary section 78 for mechanically interfering with opposite inside surfaces (not labeled) of the corresponding primary channel 64 thereby securely retaining the second contact 63 in the slot 62.

A soldering section 84 extends from the secondary section 80 of each second contact 63 and projects beyond the rear face 76 of the second housing 60 through the opening 74 of the secondary passage 70. As shown in FIGS. 7 and 8, the soldering section 84 is surface mounted to a circuit board 86 of the docking station 18. However, the soldering section 84 may be soldered to the circuit board 86 by a through hole technique. In such a case, the secondary passage 70 does not need to be exposed to the bottom face 72 of the second housing 60.

The primary section 78 of each second contact 63 comprises an inclined, resilient arm 88 extending toward the opening 66 of the front mating face 68 with an arcuate engaging portion 90 formed proximate a free end thereof and biased thereby to project beyond the front mating face 68 through the opening 66. The arm 88 resiliently supports the engaging portion 90 whereby when an external force is exerted thereon, the engaging portion 90 is pushed into the corresponding second slot 62 of the second housing 60.

Positioning posts 92 are formed on a bottom face 72 of the second housing 60 for insertion into corresponding holes 94 defined in the circuit board 86 of the docking station 18 to properly position the receptacle connector 14 with respect to the circuit board 86 of the docking station 18. Solder pads 96 may be provided on the bottom face 72 of the second housing 60 for being soldered to the circuit board 86 to more firmly fix the receptacle connector 14 to the circuit board 86 of the docking station 18.

Referring to FIGS. 7 and 8, the plug connector 12 is mounted to the circuit board 52 of the PDA 16. An enclosure 98 of the PDA 16 houses the circuit board 52 and defines an opening (not labeled) through which the plug connector 12 extends. The first housing 20 of the plug connector 12 forms a step 100 on the rear face 38 thereof for supporting a first edge 102 of the opening of the enclosure 98. A flange 106 extends from a second edge 104 of the opening of the enclosure 98 toward and abutting against the circuit board 52 whereby the flange 106 opposes and is spaced from the front face 28 of the first housing 20 and a space 108 is formed therebetween for receiving the receptacle connector 14 therein with the front mating faces 28, 68 of the plug and receptacle connectors 12, 14 slidably engaging with each other.

The receptacle connector 14 is mounted to the circuit board 86 of the docking station 18. An enclosure 110 of the docking station 18 encloses the circuit board 86 and defines an opening (not labeled) through which the receptacle connector 14 extends. Opposite steps 99 are formed on the front and rear faces 68, 76 for supporting circumferential edges 113 of the opening of the enclosure 110.

A projection 111 forming a stop face 112 is formed on the front face 68 of the second housing 60 thereby defining a receiving space 114 between the stop face 112 and the front face 68 for receiving the plug connector 12. Inserting the plug connector 12 into the receiving space 114 of the receptacle connector 14 drives the central section 40 of each first contact 24 of the plug connector 12 to engage with the engaging portion 90 of the corresponding second contact 63 of the receptacle connector 14 and the resilient arm 88 is deformed and exerts a biasing force on the engaging portion 90 thereby ensuring firm engagement between the first and second contacts 24, 63. The arcuate configuration of the engaging portion 90 ensures smooth engagement between the first and second contacts 24, 63. The concave portion 49 of each first contact 24 partially receives the engaging portion 90 of the corresponding second contact 63 for maintaining a stable engagement therebetween.

As shown in FIG. 8, when mating the connectors 12, 14, the plug connector 12 is inserted into the receiving space 114 with the receptacle connector 14 partially accommodated and securely retained in the space 108 between the plug connector 12 and the flange 106 of the enclosure 98 of the PDA 16.

The stop face 112 of the second housing 60 of the receptacle connector 14 contacts a top face 119 of the first housing 20 of the plug connector 12 and stops the movement thereof for properly positioning the plug connector 12 with respect to the receptacle connector 14 when the plug connector 12 is inserted into the receiving space 114 of the receptacle connector 14.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A connection system comprising a plug connector adapted to be mounted to an electronic device, the plug connector comprising:

a first insulative housing defining a plurality of first slots each comprising a central channel exposed to a front mating face of the first housing and at least a first passage in communication with the central channel, and a first contact received and retained in each first slot, the first contact having a central section received in the central channel and exposed to the front mating face of the first housing and at least a first limb inserted into the first passage, the first limb having a soldering section extending beyond the first housing and adapted to be soldered to a first circuit board of the electronic device; and a receptacle connector adapted to be mounted to a docking station, the receptacle connector comprising:

a second insulative housing defining a plurality of second slots, each second slot forming an opening in a front mating face of the second housing, and a second contact received in each second slot, the second contact comprising a primary section forming an arm supporting an engaging portion extending outwardly through the opening, the second contact having a soldering section extending beyond the second housing and adapted to be soldered to a second circuit board of the docking station, the second housing defining a receiving space in front of the front mating face thereof for receiving the plug connector therein whereby the central section of each first contact of the plug connector engages with the engaging portion of the corresponding second contact of the receptacle connector for establishing electrical connection therebetween;

wherein each first slot of the first housing comprises a second passage substantially parallel to the first passage thereby forming a U-shaped configuration, and wherein each first contact comprises a second limb inserted into the second passage, the first and second limbs being parallel to the first circuit board;

wherein a concave portion is formed on the central section of each first contact for firmly receiving therein the engaging portion of the corresponding second contact.

2. The connection system as claimed in claim 1, wherein the second housing forms a projection on the front mating face thereof, the projection forming a stop face, the receiving space being defined between the stop face and the front mating face of the second housing, the stop face contacting and stopping the plug connector when the plug connector is inserted into the receiving space for mating with the receptacle connector.

3. The connection system as claimed in claim 1, wherein the arm of each second contact is resilient whereby when the central section of each first contact engages with the engaging portion of the corresponding second contact, the arm is deformed to at least partially withdraw the engaging portion thereof into the corresponding second slot of the second housing.

4. The connection system as claimed in claim 1, wherein the engaging portion of each second contact has an arcuate configuration for ensuring smooth engagement thereof with the corresponding first contact.

5. The connection system as claimed in claim 1, wherein projections are formed on opposite edges of the primary section of each second contact for mechanically interfering with inside surfaces of the corresponding slot thereby securely retaining the second contact in the second slot.

6. The connection system as claimed in claim 1, wherein each second slot comprises a secondary passage exposed to a bottom face of the second housing, each second contact comprising a secondary section received in the secondary passage of the corresponding second slot for being surface mounted to the second circuit board.

7. The connection system as claimed in claim 1, wherein the second housing comprises positioning posts adapted to be inserted into holes defined in the second circuit board.

8. The connection system as claimed in claim 1, wherein solder pads are attached to the second housing and adapted to be soldered to the second circuit board for firmly mounting the second housing to the second circuit board.

9. The connection system as claimed in claim 1, wherein the docking station comprises an enclosure encasing the second circuit board, the enclosure defining an opening through which the receptacle connector extends, and wherein steps are formed on opposite faces of the second housing and adapted to support circumferential edges of the opening of the enclosure of the docking station.

10. The connection system as claimed in claim 1, wherein projections are formed on opposite edges of the first limb of each first contact for mechanically interfering with inside surfaces of the first passage of the corresponding first slot.

11. The connection system as claimed in claim 1, wherein projections are formed on opposite edges of at least one of the first and second limbs of each first contact for mechanically interfering with inside surfaces of the corresponding passage of the corresponding first slot.

12. The connection system as claimed in claim 11, wherein projections are formed on opposite edges of both the first and second limbs of each first contact for mechanically interfering with inside surfaces of the corresponding passages of the corresponding first slot.

13. The connection system as claimed in claim 4, wherein a concave portion is formed on the central section of each first contact for mating engagement with the arcuate engaging portion of the corresponding second contact.

14. The connection system as claimed in claim 1, wherein the first passage of each first slot is exposed to a bottom face of the first housing, the first limb of the corresponding first contact being surface mounted to the first circuit board.

15. The connection system as claimed in claim 1, wherein the first housing comprises positioning posts adapted to be inserted into holes defined in the first circuit board.

16. The connection system as claimed in claim 1, wherein solder pads are attached to the first housing and are adapted to be soldered to the first circuit board for firmly mounting the first housing to the first circuit board.

17. The connection system as claimed in claim 1, wherein the electronic device comprises an enclosure encasing the first circuit board, the enclosure defining an opening through which the plug connector extends, a perpendicular flange being formed on an edge of the opening and opposing and being spaced from the front mating face of the first housing for accommodating the receptacle connector therein when the plug and receptacle connectors mate with each other.

18. The connection system as claimed in claim 17, wherein a step is formed on a rear face of the first housing opposite the front mating face thereof for supporting an opposite edge of the enclosure of the electronic device.

19. The connection system as claimed in claim 1, wherein the electronic device is a personal digital assistant.

* * * * *